US005516149A

United States Patent [19]

Moore

[11] Patent Number: 5,516,149

[45] Date of Patent: May 14, 1996

[54] SKATE LIGHT APPARATUS

[76] Inventor: Robert M. Moore, 309 Old Brass Rd., Columbia, S.C. 29223

[21] Appl. No.: 194,813

[22] Filed: Feb. 14, 1994

Related U.S. Application Data

[63] Continuation of Ser. No. 2,968, Jan. 11, 1993, abandoned.

[51] Int. Cl.[6] ..... A63C 17/26

[52] U.S. Cl. ..... 280/811; 362/61; 362/103

[58] Field of Search ..... 280/11.26, 809, 280/811, 11.19, 11.23, 11.27, 87.042; 362/61, 78, 103; 248/287

[56] References Cited

U.S. PATENT DOCUMENTS

| | | | |
|---|---|---|---|
| 892,164 | 6/1908 | King | 280/11.26 |
| 1,681,841 | 8/1928 | Cohen | 280/11.26 |
| 2,140,224 | 12/1938 | Galgoczy | 362/103 X |
| 2,502,566 | 4/1950 | Hooley | 362/103 |
| 2,531,959 | 11/1950 | Woodward et al. | 362/103 X |
| 2,783,367 | 2/1957 | Locke | 248/287 X |
| 4,141,524 | 2/1979 | Corvese, Jr. | 248/287 X |
| 4,363,502 | 12/1982 | Bakerman | 362/103 X |
| 4,367,515 | 1/1983 | Beard | 362/103 |
| 4,463,412 | 7/1984 | Broach | 362/103 X |
| 4,648,610 | 3/1987 | Hegyi | 280/11.19 |

*Primary Examiner*—Margaret A. Focarino
*Assistant Examiner*—Michael Mar

[57] ABSTRACT

A new and improved skate light apparatus which includes a self-contained, battery-powered light assembly and either an adjustable bracket or an adjustable strap for connecting the light assembly to the skate. The light assembly includes a housing, a battery pack, a light source, and a switch connected between the battery pack and the light source. In addition, the light assembly may also include a rotatable reflector and an electric motor for rotating the reflector. The adjustable bracket which supports the light assembly is connected to support structures, such as struts or studs, on the skate. When a strap is used to attach the light assembly to the skate, the light assembly housing includes a slot for receiving an adjustable strap, and the adjustable strap is threaded through the slot and extends around the foot on which the skate is fitted. The adjustable strap can include hook material and complementary loop material for securing the adjustment of the strap around the foot. The light assembly can further include a sound generator, such as a tone generator. The light that is emitted from the light source can be a flashing light. In this respect, electronic circuitry can be provided to cause the light source to flash.

3 Claims, 4 Drawing Sheets

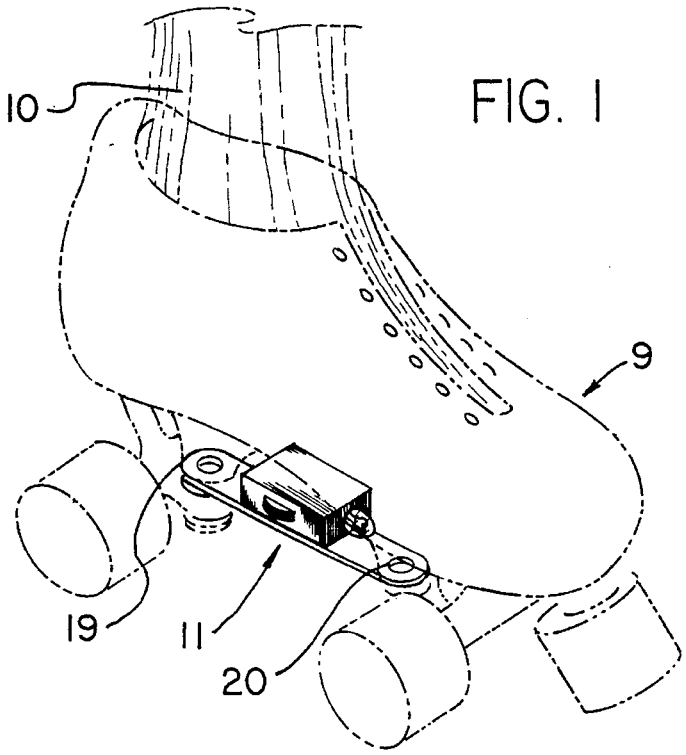
FIG. 1
FIG. 2
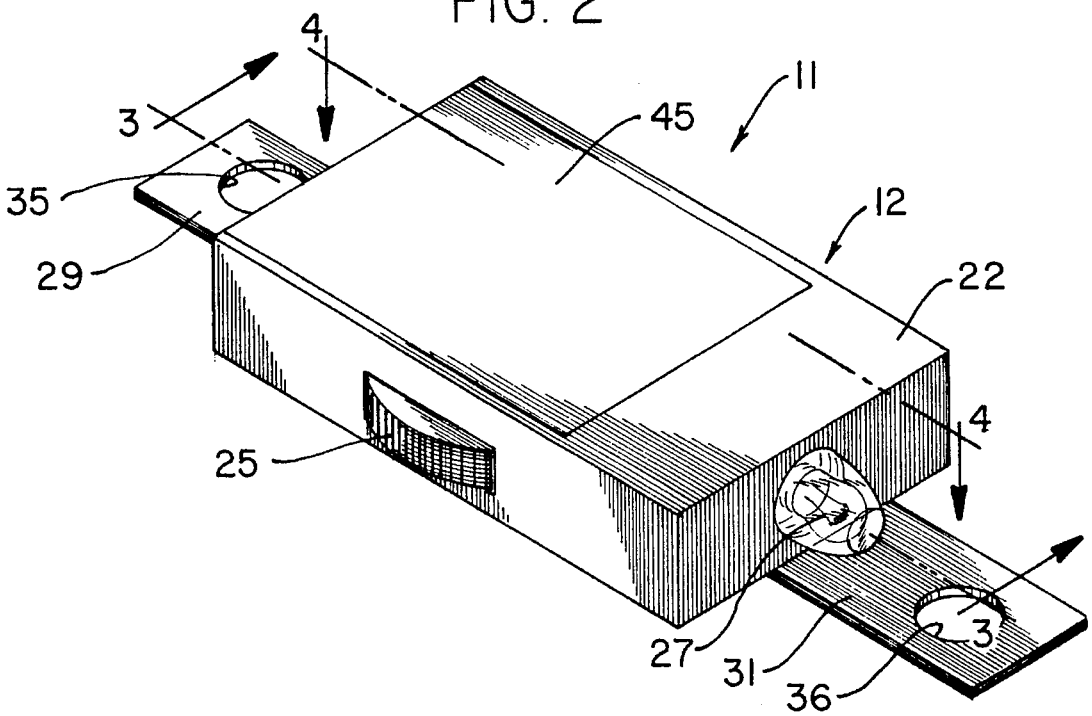

SKATE LIGHT APPARATUS

This application is a continuation of application Ser. No. 08/002,968, filed on Jan. 11, 1993, now abandoned.

BACKGROUND OF THE INVENTION

1. Field of the Invention

The present invention relates generally to skates, such as roller skates and ice skates, and more particularly, to a self-contained, battery-powered light attached to such skates.

2. Description of the Prior Art

Attaching bright colored lights to the bottom of skates is desirable for several reasons. First, such lights can help to light the path of the skater; and, second, such lights are eye-catching and aesthetically pleasing to observers. In addition, when skating takes place after dark, the lights serve as safety lights to be viewed by others such as motorists and bicycle riders.

Lights associated with roller skates are well known in the art. Generally, these lights are of two types. One type provides for an illuminated wheel. Another type provides for a light associated with the body of the skate.

The following United States patents disclose lights associated with a roller skate wheel: U.S. Pat. Nos. 3,789,208 to Lewis, 4,363,502 to Bakerman, 4,648,610 to Hegyi, and Des. 268,195 to Kalish. Illuminated wheels provide an interesting aesthetic effect. Rotating lights, associated with rotating wheels, are aesthetically pleasing. However, with respect to the illuminated wheels a number of problems present themselves. Wheels are the predominant receivers of road or surface shock as roller skates are used. As such, a wheel must be made to be durable and shock resistant. It is difficult to provide inexpensive and practical sources of illumination that are sufficiently durable and shock resistant to withstand the shocks that roller skate wheel endure. In this respect, it would be desirable if a skate had rotating lights that did not have to endure the intense road shocks that illuminated wheels endure.

The following patent discloses a skate light associated with the body of the skate: U.S. Pat. No. 4,367,515 to Beard. This patent appears to disclose a self-contained, battery-powered light in the form of a plurality of light emitting diodes in a housing which is connected to an attachment that is attached to the toe stop of the roller skate. Although this device provides a skate light that is not contained in a rolling wheel, there are a number of shortcomings associated with this device. First, not all skates have a toe stop. In this respect, it would be desirable to provide a skate light that does not require a toe stop for connecting the light to the skate.

Although the light emitting diodes provided with the Beard patent may provide interesting light effects, they do not provide a rotating light such as present with rotating, illuminated wheels. Therefore, it would be desirable if a rotating skate light were provided that is attached to the body of the skate.

There are many kinds of skates with many types of structural designs. Many people who currently possess such skates would like to have skates that have lights, but they would prefer not to have to buy new skates just for the purpose of providing illumination. In this respect, it would be desirable, therefore, if a skate light could be retrofitted to virtually any skate, regardless of the specific structural design of the skate.

The variety of sensory effects that are provided by visible skate lights may be added to if a sound producing element, such as a tone generator, would be associated with the skate-mounted light source. In this respect, it would be desirable if a skate light assembly included a sound source.

Thus, while the foregoing body of prior art indicates it to be well known to use lights on skates, the provision of a more simple and cost effective device is not contemplated. Nor does the prior art described above teach or suggest a skate that has rotating lights that do not have to endure the intense road shocks that illuminated wheels endure. The prior art does not provide a rotating skate light, attached to the body of the skate, that does not require a toe stop for connecting the light to the skate. Moreover, the prior art does not provide a skate light that can be retrofitted to virtually any skate, regardless of the specific structural design of the skate. In addition, the prior art does not provide a skate light assembly that includes a sound source. The foregoing disadvantages are overcome by the unique skate light apparatus of the present invention as will be made apparent from the following description thereof. Other advantages of the present invention over the prior art also will be rendered evident.

SUMMARY OF THE INVENTION

To achieve the foregoing and other advantages, the present invention, briefly described, provides a new and improved skate light apparatus which includes a self-contained, battery-powered light assembly and either an adjustable bracket or an adjustable strap for connecting the light assembly to the skate. The light assembly includes a housing, a battery pack, a light source, and a switch connected between the battery pack and the light source. In addition, the light assembly may also include a rotatable reflector and an electric motor for rotating the reflector. The adjustable bracket which supports the light assembly is connected to support structures, such as struts or studs, on the skate. When a strap is used to attach the light assembly to the skate, the light assembly housing includes a slot for receiving an adjustable strap, and the adjustable strap is threaded through the slot and extends around the foot on which the skate is fitted. The adjustable strap can include hook material and complementary loop material for securing the adjustment of the strap around the foot. The light assembly can further include a sound generator, such as a tone generator. The light that is emitted from the light source can be a flashing light. In this respect, electronic circuitry can be provided to cause the light source to flash.

The above brief description sets forth rather broadly the more important features of the present invention in order that the detailed description thereof that follows may be better understood, and in order that the present contributions to the art may be better appreciated. There are, of course, additional features of the invention that will be described hereinafter and which will be for the subject matter of the claims appended hereto.

In this respect, before explaining at least three preferred embodiments of the invention in detail, it is understood that the invention is not limited in its application to the details of the construction and to the arrangements of the components set forth in the following description or illustrated in the drawings. The invention is capable of other embodiments and of being practiced and carried out in various ways. Also, it is to be understood, that the phraseology and terminology employed herein are for the purpose of description and should not be regarded as limiting.

As such, those skilled in the art will appreciate that the conception, upon which disclosure is based, may readily be utilized as a basis for designing other structures, methods, and systems for carrying out the several purposes of the present invention. It is important, therefore, that the claims be regarded as including such equivalent constructions insofar as they do not depart from the spirit and scope of the present invention.

Further, the purpose of the foregoing Abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. Accordingly, the Abstract is neither intended to define the invention or the application, which only is measured by the claims, nor is it intended to be limiting as to the scope of the invention in any way.

It is therefore an object of the present invention to provide a new and improved skate light apparatus which has all of the advantages of the prior art and none of the disadvantages.

It is another object of the present invention to provide a new and improved skate light apparatus which may be easily and efficiently manufactured and marketed.

It is a further object of the present invention to provide a new and improved skate light apparatus which is of durable and reliable construction.

An even further object of the present invention is to provide a new and improved skate light apparatus which is susceptible of a low cost of manufacture with regard to both materials and labor, and which accordingly is then susceptible of low prices of sale to the consuming public, thereby making such skate light apparatus available to the buying public.

Still yet a further object of the present invention is to provide a new and improved skate light apparatus that has rotating lights that do not have to endure the intense road shocks that illuminated wheels endure.

Still another object of the present invention is to provide a new and improved skate light apparatus that does not require a toe stop for connecting the light to the skate.

Yet another object of the present invention is to provide a new and improved skate light apparatus that provides a rotating skate light that is attached to the body of the skate.

Even another object of the present invention is to provide a new and improved skate light apparatus that can be retrofitted to virtually any skate, regardless of the specific structural design of the skate.

Still a further object of the present invention is to provide a new and improved skate light apparatus that includes a sound source.

These together with still other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there are illustrated preferred embodiments of the invention.

BRIEF DESCRIPTION OF THE DRAWINGS

The invention will be better understood and the above objects as well as objects other than those set forth above will become more apparent after a study of the following detailed description thereof. Such description makes reference to the annexed drawing wherein:

FIG. 1 is a perspective view showing a first preferred embodiment of the skate light apparatus of the invention installed on a skate worn on a foot using an adjustable bracket.

FIG. 2 is an enlarged perspective view of the embodiment of the skate light apparatus shown in FIG. 1.

DESCRIPTION OF THE PREFERRED EMBODIMENT

With reference to the drawings, a new and improved skate light apparatus embodying the principles and concepts of the present invention will be described.

Figure 3:
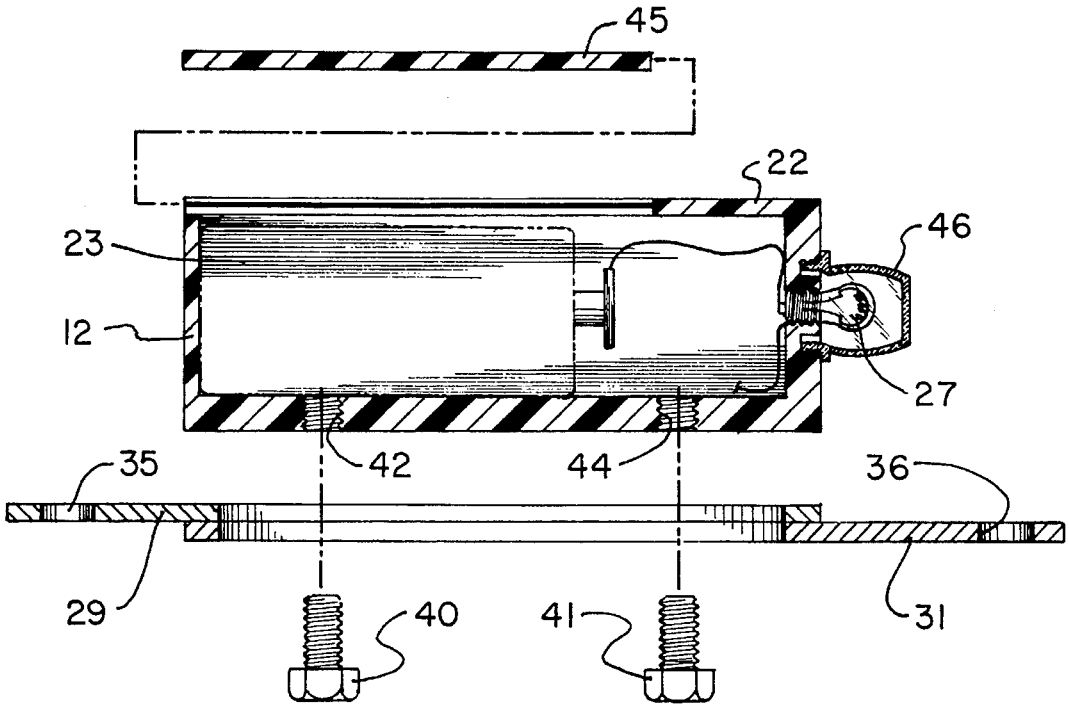
FIG. 3 is a cross-sectional, partially exploded view of the skate light apparatus of FIG. 2 taken along line 3—3 thereof.
Figure 4:
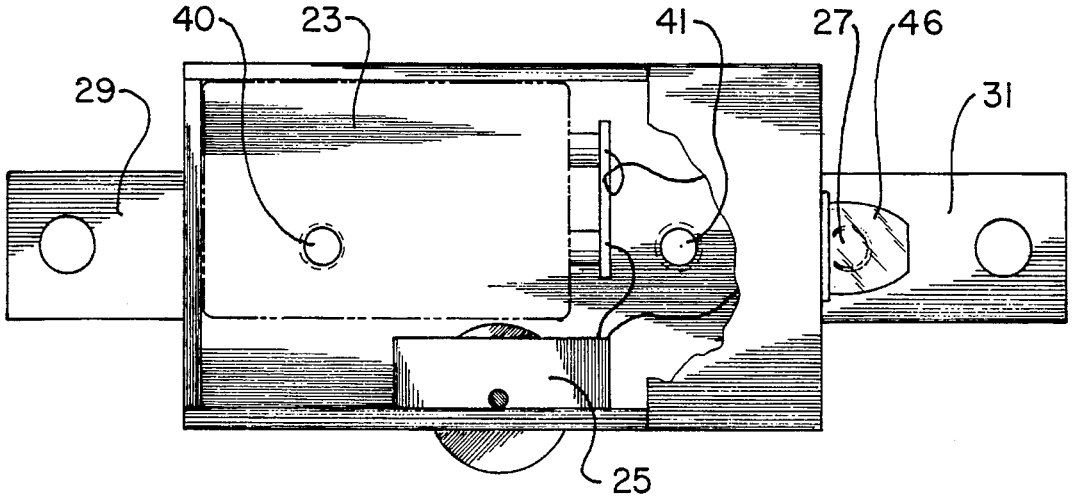
FIG. 4 is a top plan view of the skate light apparatus, taken along the line 4—4 of FIG. 2, shown with part of the housing removed.

Turning initially to FIGS. 1–3, there is shown a first exemplary embodiment of the skate light apparatus used with a skate 9 worn on a foot 10. The skate light apparatus 11 is comprised of a self-contained, battery-powered light assembly 12 and an adjustable means for connecting the light assembly to the skate. In this embodiment, the adjustable connecting means includes an adjustable bracket 18 which supports the light assembly 12 and which is connected to support structures, e.g. studs 19 and 20 on the skate 9 through holes 35 and 36. The adjustable bracket 18 includes a slotted first adjustment member 29 and a slotted second adjustment member 31. The first adjustment member 29 and second adjustment member 31 are in sliding contact and are secured to one another by bolts 40 and 41 which pass through the slots in members 29 and 31 and exert pressure between the first and second adjustment members when they are screwed into threaded holes 42 and 44 of the light assembly 12.

More specifically, the light assembly 12 includes a housing 22, a battery pack 23, a switch 25, and a light source 27. The battery pack 23 is connected to the light source 27 through the switch 25. The housing 22 has a removable cover 45 that can be removed to gain access to the battery pack 23. A clear plastic dome 46 can be used to protect the light source 27. The dome 46 can have threads that screw into complementary threads in one of the walls of the housing 22.

Figure 5:
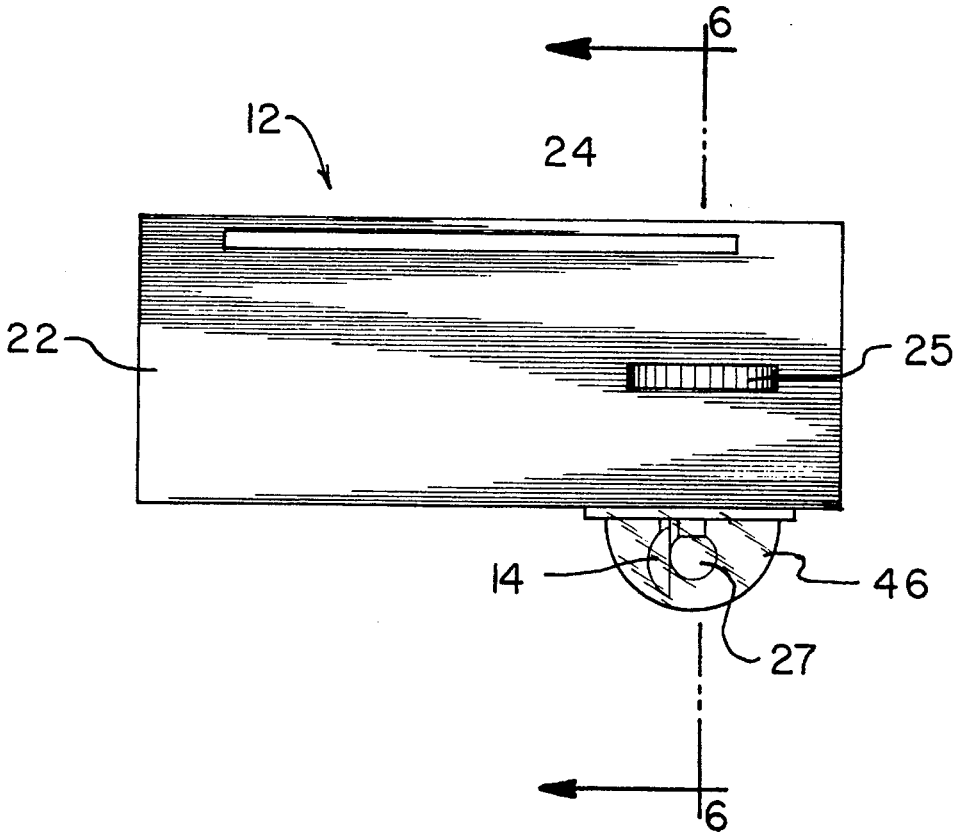
FIG. 5 is a side view of a second preferred embodiment of the invention that includes a slot in the housing of the light assembly for receipt of a strap (shown in FIG. 7) that is used to encircle a skater's foot.
Figure 6:
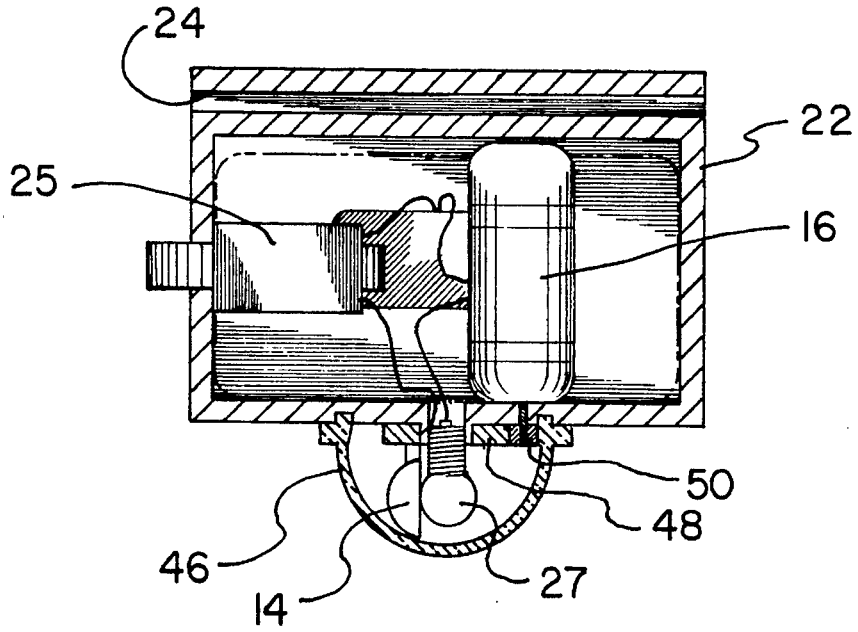
FIG. 6 a cross-sectional view of the embodiment shown in FIG. 5 taken along the line 5—5 thereof.
Figure 7:
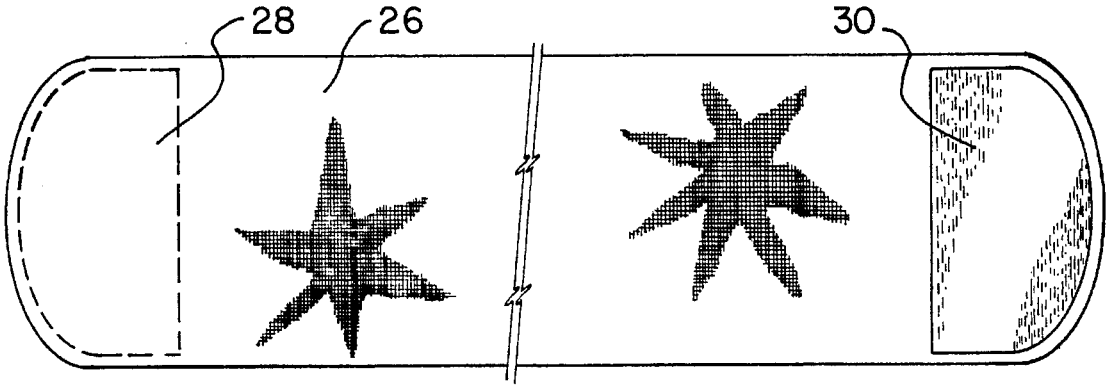
FIG. 7 is a top view of a strap that is used in conjunction with the second preferred embodiment of the invention shown in FIG. 5.

Turning to FIGS. 5–7, a second embodiment of the skate light apparatus of the invention is shown. Reference numerals are shown that correspond to like reference numerals that designate like elements shown in the other figures. In addition, the light assembly 12 of the skate light apparatus includes a housing 22 which includes a slot 24 for receiving an adjustable strap 26 (shown in FIG. 7). The adjustable strap 26 is threaded through the slot 24 on the housing 22 and extends around the foot 10 when the strap 26 is used to attach the light assembly 12 to the skate 9. As shown in FIG. 7, the adjustable strap 26 includes hook material 28 and a loop material 30 for adjusting the strap 26 around the foot 10 residing in the skate 9. Suitable hook and loop material can be made from VELCRO(TM).

In addition, as shown in FIGS. 5–6, the light assembly 12 includes a rotatable reflector 14 and a small, battery-powered electric motor 16 for rotating the reflector 14. The reflector 14 rotates the light from the light source 27 in a rotating pattern. The battery pack 23 is connected to the light source 27 and to the rotating through the switch 25. The reflector 14 is connected to a first gear 48 which meshes with a second gear 50 that is present on the output shaft of the motor 16. As the motor shaft 16 rotates, the second gear 50 rotates, the first 48 rotates, and the reflector 14 rotates around the light source 27 which is centrally located with respect to the first gear 48.

Figure 8:
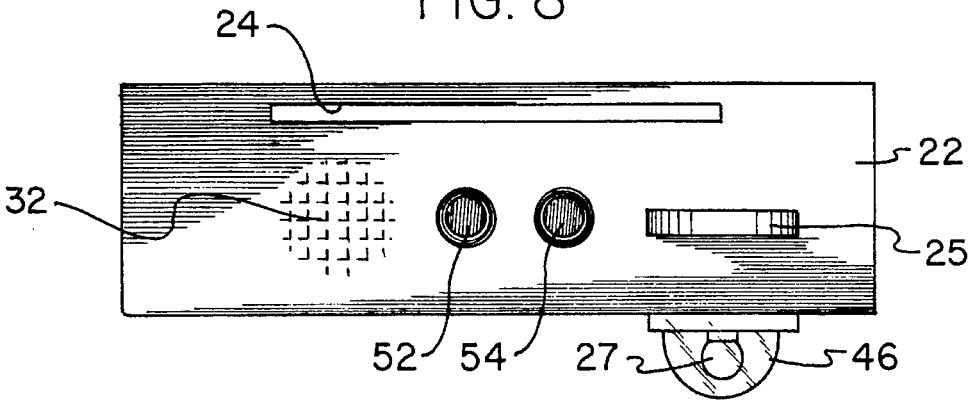
FIG. 8 is a side view of a third preferred embodiment of the invention which includes a sound generator.

Turning to FIG. 8, a third preferred embodiment of the skate light apparatus of the invention is shown. Reference numerals are shown that correspond to like reference numerals that designate like elements shown in the other figures. In addition, in FIG. 8, a sound generating device, such as a tone generator represented by tone generator speaker 32, is included. Also included in the tone generator are a first control 52 to control the rate of tone generation and a second control 54 to control the tone of the tone generation.

Figure 9:
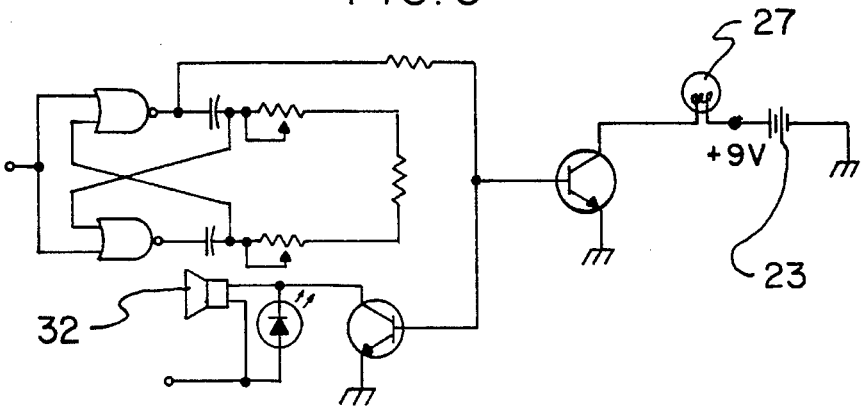
FIG. 9 is an electrical schematic diagram showing circuitry that can be used to cause the light source to flash.

As shown in FIG. 9, strobe electrical circuitry, powered by battery pack 23 is provided to provide a flashing light source 27 and a cyclic tone generated from speaker 32. Other well known electric circuits can be used for generating tones and for controlling the flashing of the light.

The light sources especially preferred are miniature light bulbs commonly used as Christmas tree lights. Such light bulbs are readily available in different colors. The battery pack can include rechargeable batteries, or they can include disposable batteries. In the embodiments disclosed in the drawings herein, the battery pack is a single 9 volt battery.

Preferably, the housing and the other components of the skate light apparatus of the invention would be made of inexpensive plastic and would be waterproof so that the skate light of the invention can be used in wet weather and on ice skates.

It is apparent from the above that the present invention accomplishes all of the objects set forth by providing a new and improved skate light apparatus that is low in cost, relatively simple in design and operation, and which may advantageously be used to provide an easily attached, rotating and flashing skate light apparatus.

With respect to the above description, it should be realized that the optimum dimensional relationships for the parts of the invention, to include variations in size, form function and manner of operation, assembly and use, are deemed readily apparent and obvious to those skilled in the art, and therefore, all relationships equivalent to those illustrated in the drawings and described in the specification are intended to be encompassed only by the scope of appended claims.

While the present invention has been shown in the drawings and fully described above with particularity and detail in connection with what is presently deemed to be the most practical and preferred embodiments of the invention, it will be apparent to those of ordinary skill in the art that many modifications thereof may be made without departing from the principles and concepts set forth herein. Hence, the proper scope of the present invention should be determined only by the broadest interpretation of the appended claims so as to encompass all such modifications and equivalents.

What is claimed as being new and desired to be protected by LETTERS PATENT of the United States is as follows:

1. A light apparatus for a skate worn on a foot and having a pair of spaced supporting structures thereon, said skate light apparatus comprising:

a housing, said housing including a self-contained, battery-powered light assembly;

adjustable means connecting said light assembly to the skate, wherein said adjustable connecting means includes an adjustable bracket which supports said light assembly and which is connected to said pair of spaced supporting structures on the skate;

wherein said adjustable bracket includes a first adjustment member and a second adjustment member;

said first adjustment member and said second adjustment member being in overlapping, sliding contact with one another, said first adjustment member and said second adjustment member each having a slot such that when said first and second adjustment members are in sliding contact with one another and connected to said supporting structures said slots define a common opening through said first and second adjustment members, said common opening having first and second longitudinally opposed ends; and said first adjustment member and said second adjustment member being adapted to be secured to one another and to said housing by tightenable fastener means adapted to extend through said common opening a distance spaced inwardly from longitudinally opposed edges forming said ends of said common opening and to be secured to said housing thereby exerting pressure between said first and second adjustment members and said housing, said tightenable fastener means comprising a first fastener and a second fastener, said first and second fasteners extending through said common opening in a longitudinally spaced relation to each other as defined by the longitudinal extent of said common opening thereby to engage said housing as aforesaid, each of said first and second adjustment members having means for fastening said housing to a separate one of said pair of supporting structures on said skate, said means for fastening said housing comprising a separate opening in said first and second adjustment members respectively spaced from said common opening such that said first and second adjustment members and said housing are adapted to be attached to said pair of spaced supporting structures through each of said separate openings, respectively.

2. The apparatus described in claim 1 wherein said light assembly includes means for providing a flashing light.

3. The apparatus described in claim 2 wherein said means for providing a flashing light includes strobe electric circuitry.

* * * * *